US006656230B1

(12) United States Patent
Zaher et al.

(10) Patent No.: US 6,656,230 B1
(45) Date of Patent: Dec. 2, 2003

(54) METHOD AND DEVICE FOR TRANSFERRING A COLOR PATTERN ON OR INTO AN OBJECT

(75) Inventors: Maximilian Zaher, Oldenburg (DE); Thomas Walter, Oldenburg (DE); Franz Kampmeier, Oldenburg (DE)

(73) Assignee: Bush Industries, Inc., Jamestown, NY (US)

( * ) Notice: Subject to any disclaimer, the term of this patent is extended or adjusted under 35 U.S.C. 154(b) by 0 days.

(21) Appl. No.: 09/601,546

(22) PCT Filed: Jan. 29, 1999

(86) PCT No.: PCT/EP99/00601

§ 371 (c)(1),
(2), (4) Date: Oct. 11, 2001

(87) PCT Pub. No.: WO99/39915

PCT Pub. Date: Aug. 12, 1999

(30) Foreign Application Priority Data

Feb. 3, 1998 (DE) ..... 198 04 218

(51) Int. Cl.[7] ..... D06F 5/28; B41F 16/02

(52) U.S. Cl. ..... 8/471; 8/468; 156/230; 156/580

(58) Field of Search ..... 8/471; 156/230, 156/580

(56) References Cited

U.S. PATENT DOCUMENTS 4,664,672 A * 5/1987 Krajec et al.
6,001,206 A 12/1999 Zaher

FOREIGN PATENT DOCUMENTS

EP 0 282 859 B1 2/1991
EP 0 573 676 B1 7/1998

* cited by examiner

*Primary Examiner*—Margaret Einsmann
(74) *Attorney, Agent, or Firm*—Webb Ziesenheim Logsdon Orkin & Hanson, P.C.

(57) ABSTRACT

The invention relates to a method and a device for transferring a color pattern on or into an object, using a support which is printed with the color pattern. The color pattern is transferred from the support onto an object to be decorated. A gas jet is used to help apply the support to the object.

12 Claims, 2 Drawing Sheets

METHOD AND DEVICE FOR TRANSFERRING A COLOR PATTERN ON OR INTO AN OBJECT

The invention relates to a process and a device for applying and/or introducing a coloured decoration respectively to or into an article, in which a substrate with dye is applied against the article so as to transfer dye from the substrate to the article.

The invention is based on prior art as known from EP-A 0 282 859 "Process and device for applying decoration to an article". In this prior art, a coloured decoration of sublimable dyes is initially applied to a substrate. The substrate may consist of paper, for example. This coloured decoration is then transferred from the substrate to the article to be decorated. The article may consist for example of a suitable plastics or of another material coated with plastics or lacquer for example. For transfer of the coloured decoration, the substrate is positioned over the article and the coloured decoration is transferred by temperature increase from the substrate to the article by means of sublimation. To achieve a uniform arrangement of the substrate against the article and homogeneous pressure distribution, in the cited prior art a cloth of resilient material (e.g. silicone) is positioned over the substrate. Using a vacuum pump, a vacuum is generated over the table on which the article is positioned with the substrate and covering cloth, which vacuum sucks up the substrate and the cloth lying thereover. The present invention may be applied to this prior art, for example, with or without a silicone cloth.

In addition, the invention is based on prior art as known from EP-A 0 573 676 "Use of a substrate with "release" properties for applying lacquer and paint to a substrate" In this prior art, substrates (e.g. of suitable paper) with so-called "release" properties are used for transfer of decoration onto an article. The "release" property of the substrate means that the decoration may be peeled off the substrate in the manner of a "decal" and transferred to the substrate in this way.

The object of the invention is to improve the processes or devices according to the above-mentioned prior art, in particular in relation to the quality of the coloured decoration.

The process according to the invention is characterised in claim 1. According thereto, at least one gas jet is used to promote application of the substrate with the coloured decoration against the article to be decorated. This technique may be used in particular both in the case of the above-mentioned sublimation transfer and in the case of "release" transfer of the coloured decoration. The gas jet causes the substrate to lie closely against the article over the entire area without gas inclusions or other non-uniformities. The gas jet may be passed over the article with the substrate lying thereon (and optionally the resilient cloth lying thereon) in the manner of a "doctor blade". Gas inclusions are pressed out, ensuring that the substrate lies closely against the article all over.

It is preferably provided that the gas jet has a dimension, in at least one direction, which is small in comparison with the dimension of the article in this direction. It is particularly preferable for the gas jet to take the form of a knife and-to be passed in linear manner over the substrate or the cloth optionally lying thereon. The linear gas jet is preferably of a length which is greater than the width of the article plus the overlapping areas of the substrate or the cloth.

Moreover, if the gas jet takes the above-described knife form, the direction of the line of at least one gas jet forms an angle other than 0° and 90° with the direction of relative movement between gas jet and article.

A further preferred development of the invention, which is used in particular when sublimable dyes are used in the coloured decoration, provides for the gas jet to be heated to a temperature at which it ensures or at least promotes sublimation of the dye and thus transfer thereof from the substrate to the article.

The invention in particular allows the coloured decoration of the article to exhibit a high quality in the edge area, if the gas jet is directed appropriately obliquely at the edge area, wherein it presses the substrate down uniformly on both sides of the edge.

When a heated gas jet is used the jet is preferably positioned obliquely relative to the relative movement between article and jet in such a way that the areas of the substrate which extend towards the gas jet are subject to preheating. The hot air of the gas jet after impingement thus flows in an "upstream" direction with regard to the relative movement between article and gas jet.

The gas jet according to the invention may be used with or without the above-described suction effect using a vacuum pump.

The invention also relates to a device with a gas jet which promotes application of the substrate against the article to be decorated. The device may preferably comprise one or more of the above-mentioned features or also one or more features from the following description of preferred exemplary embodiments of the invention, given with reference to the drawings, in which.

Figure 1:
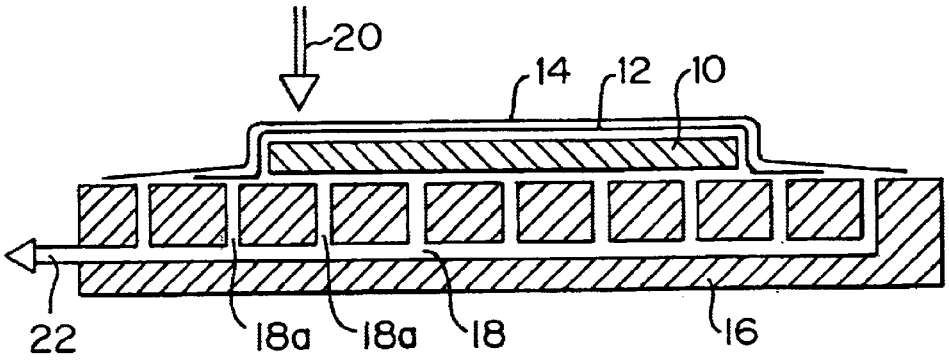
FIG. 1 is a schematic representation of, a device for applying and/or introducing a coloured decoration respectively to or into an article.

FIG. 1 shows an article 10 to be decorated. In the exemplary embodiment shown, the article 10 is to be decorated with sublimable disperse dyes. The article 10 may consist of plastics, for example, into which the dye molecules may diffuse. First of all, the coloured decoration is printed onto a substrate 12. In the exemplary embodiment shown, the substrate 12 consists of paper. The substrate 12 according to FIG. 1 is positioned over the article 10 with the printed side downwards, such that the paper projects beyond the edges. A resilient cloth 14, e.g. of silicone, is positioned over the substrate 12. The article 10, with the substrate 12 and the cloth 14, lies on a table 16. A channel 18 with branches 18*a* is formed in the table 16. The arrow 22 indicates a connection to a suction pump (not shown), which generates a vacuum directly over the table top via the channels 18 and the branches 18*a*, such that the cloth 14 and the substrate 12 arranged therebelow are sucked up and drawn over the article 10. This is described as such in the above-mentioned prior art.

A gas jet 20 acts on the cloth 14 and thereby presses the substrate 12 against the article 10. As shown in the plan view according to FIG. 2, the gas jet 20 is linear in form, with a line width which is very small in comparison to the dimension of the article 10. The narrow elongate gas jet 20 may have a width of a few millimetres, for example, e.g. a minimum width of approximately 1 mm and a maximum width of 10 mm or less.

Figure 2:
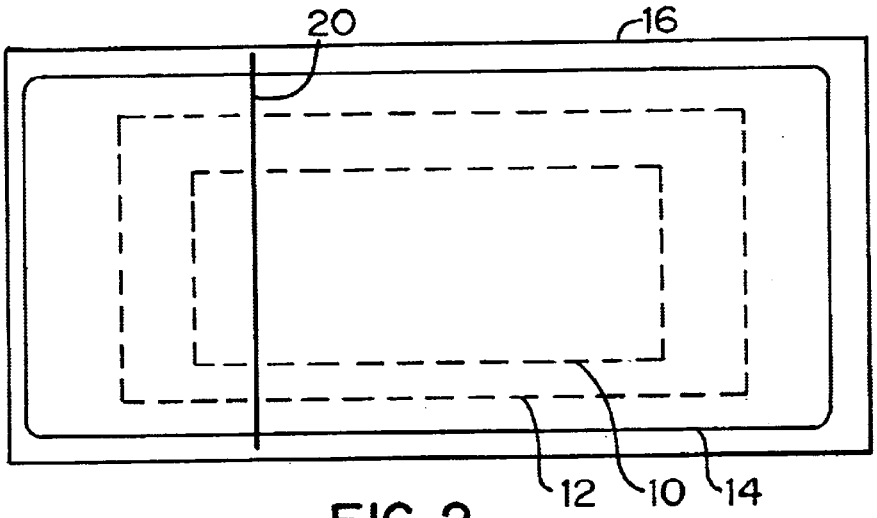
FIG. 2 is a plan view of the device according to FIG. 1.

The gas jet 20 is passed over the article 10 in such a way that it moves over the substrate 14 and the article 10 located therebelow gradually from left to right for example in FIGS. 1 and 2. The gas jet passes thereover in particular in such a way that it ensures a clean transfer of the coloured decoration in the critical edge area of the article. This is explained in more detail below with reference to FIG. 5.

Figure 3:
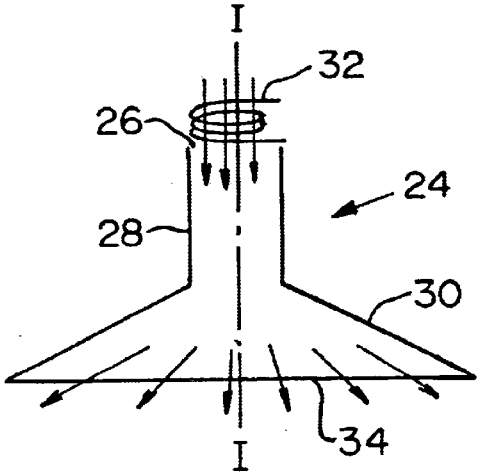
FIG. 3 is a schematic representation of a gas jet generator.
Figure 4:
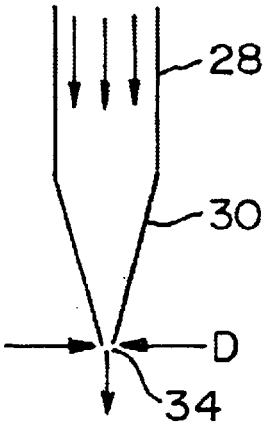
FIG. 4 shows a section along line I—I through the gas jet generator according to FIG. 3

FIGS. 3 and 4 are schematic representations of an exemplary embodiment of a gas jet generator 24. The gas jet generator comprises a connection piece 28, into which hot air flows through an inlet 16 in the direction of the arrows. A blower (not shown) is arranged upstream of the connection piece. A heating device for the gas is indicated schematically by reference numeral 32. The hot gas stream enters a funnel 30 through the connection piece 28, said funnel 30 tapering according to FIG. 4 to form a nozzle 34 with the diameter "D". This structure of the funnel 30 generates a linear gas jet 20 according to FIG. 2. The gas passes through the funnel 30 in such a way that, owing to a suitable-structure of the funnel 30 and/or special chokes in the funnel, the hot gas stream exiting through the nozzle 34 is at least approximately homogeneous over the entire length of the linear gas jet 20 (c.f. FIG. 2), i.e. the gas jet has at least approximately the same intensity and speed in each surface unit, such that the distribution of pressure produced by the gas jet between substrate and article is substantially homogeneous over the entire extent of the gas jet.

The gas jet 20 is heated to a temperature at which it heats the substrate 12 and the coloured decoration printed thereon to such an extent that the desired sublimation of the dye molecules proceeds for the purpose of transfer to the article 10. In this way, very homogeneous heating is achieved in the active area of the gas jet and sublimation may be performed very effectively in a short time. Energy consumption is reduced considerably in comparison with the IR light sources to be found in the prior art.

The gas jet may be easily controlled with regard to a series of parameters, such as for example with regard to the pressure produced at the substrate and/or the temperature of the gas. In this way, optimum adaptation to the conditions of the article to be printed and the substrate may be achieved.

Figure 5:
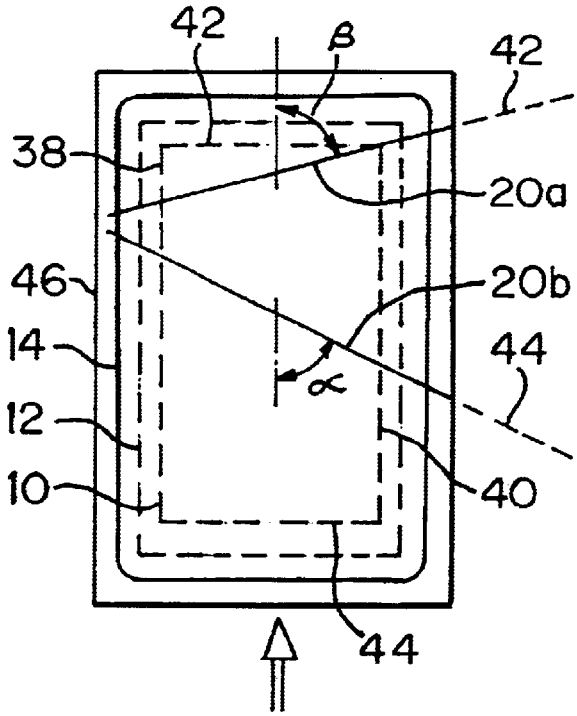
FIG. 5 shows a modification of the device according to FIG. 1 with two gas jets.

FIG. 5 is a schematic representation of a modification of the above-described exemplary embodiment with two gas jets 20*a* and 20*b*. The table 16 here takes the form of a trolley which moves in the direction of the arrow 36 in FIG. 5. The two linear gas jets. 20*a*, 20*b* are stationary. The edges of the article 10 are designated with reference numerals 38, 40, 42, 44 in FIG. 5. The two linear gas jets 20*a*, 20*b* form angles $\alpha$ and $\beta$ respectively with the feed direction 36, i.e. the direction of relative movement between the table 16 and the gas jets. The first gas jet 20*a* acts obliquely on the leading edge 42 and the side edge 38 of the article 10, such that the substrate is pressed uniformly thereon also in the edge area. The oblique arrangement results in particularly high-quality dye transfer in the edge area. The likewise obliquely Positioned second gas jet 20*b* acts on the leading edge 42 and the other side edge 40 of the article 10.

In addition to the oblique arrangement shown in FIG. 5 of the linear gas jets 20*a* and 20*b*, the knife-form gas jets may also be positioned obliquely with respect to the plane of the drawing, i.e. the angle between the "knife blade" of the gas jet and the surface of the substrate 12 or cloth 14 is not necessarily equal to 90°. An oblique arrangement of the gas jet relative to the main plane of the substrate 12 has the result that the hot gases flow counter to the direction of relative movement 36 and thus the substrate 12 is preheated prior to entry into the active area of the gas jet. It goes without saying that air is suitable as the gas. The oblique arrangement of the gas jets also allows uniform heating in particular in the edge area.

The above-described process and the device may be modified, for example to the effect that, when a substrate with "release" properties is used, the process is performed without a silicone cloth. In this case, it is also frequently possible to dispense with heating of the gas.

What is claimed is:

1. A method of applying a colour decoration onto and/or into an object, said method comprising bringing a carrier provided with dye in contact with the object in order to transfer dye from the carrier onto the object, and enhancing the contact between the carrier and the object by means of at least one gas jet, characterized in that at least one gas jet covers at least one edge of the object with the carrier such that the carrier is pressed homogeneously onto the object, wherein the jet is capable of covering both sides of the at least one edge with the carrier and wherein the gas jet has in at least one direction a dimension of between 1 and 10 millimeters.

2. The method according to claim 1, characterized in that the gas jet has the shape of a knife and is guided as a line across the carrier or a web, and the jet may be guided such that the direction of the line of at least one gas jet is capable of forming an angle ($\alpha$, $\beta$) with the direction of the relative movement of the gas jet and the object, said angle being different from 0° and 90°.

3. The method according to claim 1, characterized in that the gas jet has, in at least one direction, the dimension which is small as compared to the dimension of the object in this direction.

4. The method according to claim 1, characterized in that a sublimable dye is used and that the gas jet is heated at a temperature at which the gas jet causes or at least enhances the sublimation of the dye from the carrier onto the object.

5. The method according to claim 1, characterized in that the carrier has release properties in order to enhance the transfer of the colour decoration onto the object.

6. The method according to claim 1, characterized in that a relative movement between the gas jet and the carrier and the object is performed.

7. The method according to claim 1, characterized in that a web of resilient material is arranged on top of the carrier.

8. The method according to claim 1, characterized in that the carrier is made from paper.

9. The method according to claim 1 wherein the carrier is pressed homogeneously onto the object, including both sides of the at least one edge.

10. An apparatus for applying a colour decoration onto and/or into an object comprising:

a) a table upon which the object is arranged;

b) a carrier arranged on the object the carrier comprising a colour decoration to be transferred; and c) at least one gas jet generator for generating a gas jet which pushes the carrier onto the object, wherein the at least one gas jet covers at least one edge of the object with the carrier and wherein the jet has, in at least one direction, a dimension of between 1 and 10 millimeters, such that the carrier is pressed homogeneously onto the object, and wherein the at least one gas jet is capable of pressing the carrier against both sides of at least one edge of the object.

11. The apparatus according to claim 10, characterized in that the gas jet has the shape of a knife and is guided as a line across the carrier or a web, and the jet may be guided such that the direction of the line of at least one gas jet is capable of forming an angle ($\alpha$, $\beta$) with the direction of the relative movement of the gas jet and the object, said angle being different from 0° and 90°.

12. A method of applying a colour decoration onto and/or into an object, said method comprising bringing a carrier provided with dye in contact with the object in order to transfer dye from the carrier onto the object, and enhancing the contact between the carrier and the object by means of at least one gas jet, characterized in that at least one gas jet covers at least one edge of the object with the carrier such that the carrier is pressed homogeneously onto the object, including the sides of at least one edge, wherein the gas jet has the shape of a knife and is guided as a line across the carrier or a web, and that the direction of the line of at least one gas jet forms an angle ($\alpha$, $\beta$) with the direction of the relative movement of the gas jet and the object, said angle being oblique.

* * * * *

UNITED STATES PATENT AND TRADEMARK OFFICE

CERTIFICATE OF CORRECTION

PATENT NO. : 6,656,230 B1
DATED : December 2, 2003
INVENTOR(S) : Zaher et al.

It is certified that error appears in the above-identified patent and that said Letters Patent is hereby corrected as shown below:

Column 4,
Line 54, "object the" should read -- object, the --.

Signed and Sealed this

Fifth Day of April, 2005

JON W. DUDAS
*Director of the United States Patent and Trademark Office*